US006474121B2

(12) United States Patent
Sakai et al.

(10) Patent No.: US 6,474,121 B2
(45) Date of Patent: Nov. 5, 2002

(54) LOCK SETTING CHANGING UNIT

(75) Inventors: Nobuyo Sakai, Tokyo; Osamu Ishikawa, Toride, both of (JP)

(73) Assignee: Keiden Sangyo Co., Ltd., Tokyo (JP)

( * ) Notice: Subject to any disclaimer, the term of this patent is extended or adjusted under 35 U.S.C. 154(b) by 2 days.

(21) Appl. No.: 09/819,335

(22) Filed: Mar. 28, 2001

(65) Prior Publication Data

US 2001/0027670 A1 Oct. 11, 2001

(30) Foreign Application Priority Data

Apr. 10, 2000 (JP) ..... 2000-108459

(51) Int. Cl.[7] ..... E05B 47/00

(52) U.S. Cl. ..... 70/276; 70/276; 70/382; 70/383; 70/384; 70/413

(58) Field of Search ..... 70/276, 382, 383, 70/384, 413

(56) References Cited

U.S. PATENT DOCUMENTS 4,312,198 A * 1/1982 Sedley ..... 70/222
4,932,228 A * 6/1990 Eisermann ..... 194/248
5,211,040 A * 5/1993 Gisiger ..... 70/312
5,406,815 A * 4/1995 Sedley ..... 70/276
5,664,449 A * 9/1997 Sedley ..... 70/276

* cited by examiner

*Primary Examiner*—Anthony Knight
*Assistant Examiner*—Christopher Boswell
(74) *Attorney, Agent, or Firm*—Pitney, Hardin, Kipp & Szuch LLP

(57) ABSTRACT

In a locking system constituted by a housing, a slider provided in the housing and including magnetic lock pins, and a pair of plates provided in the housing so that a magnetic card key can be inserted between the plates, a lock setting changing unit is configured such that a disc rotatable to change magnetic lock setting is inserted into at least one circular recess portion of a slider, the disc is provided with engagement means for preventing a setting tool from being relieved in the middle of changing the magnetic lock setting, the setting tool is inserted into a center hole of the rotatable disc, and after the disc is rotated by the setting tool so that the magnetic lock setting can be changed into a new magnetic lock setting position, the setting tool is allowed to be relieved from the disc.

3 Claims, 5 Drawing Sheets

LOCK SETTING CHANGING UNIT

BACKGROUND OF THE INVENTION

1. Field of the Invention

The present invention relates to a lock setting changing unit which can change the lock state of a locking system using a magnetic card key, and particularly relates to a lock setting changing unit suitable for use in a guest room of a hotel or the like.

2. Description of Related Art

As a locking system for a guest room of a hotel or the like, it is widely known that, for example, as disclosed in JP-B-58-41391, German Patent No. 2,753,206, or the like, the room can be locked/unlocked from the outside by using a key while the room can be locked/unlocked from the inside by operating a knob. However, there has been a problem that the locked state of such a locking system can be unlocked from the outside by using a regular-use key even if the room has been locked from the inside. In consideration of such a problem in safety, there has been developed a lock state display system which shows the locking state effected in the inside of the room to the outside of the room, and at the same time, prevents unlocking from the outside by a regular-use key, for example, as disclosed in JP-B-61-39475, or the like.

Further, if a guest of a hotel lost or missed the room key, there would be a risk that the key may be abused to cause theft. Therefore, there has been desired a locking system which can change the magnetic lock setting of the locking system to prevent the room from being unlocked with the card key of the preceding guest after the guest checked out. Thus, a lock setting changing unit which can change the magnetic lock setting has been developed. However, if an operator changed the setting of the lock without becoming aware that a setting tool comes out before he changes the lock setting correctly, there occurs an accident that the lock can be unlocked even with the card key of the guest who stayed the room prior to the change of the lock setting.

SUMMARY OF THE INVENTION

It is an object of the present invention to provide a lock setting changing unit for a locking system using a magnetic card key, said unit having changing means in which a setting tool is prevented from coming out in the middle of changing the magnetic lock setting so that the magnetic lock setting can be changed correctly.

The above object can be achieved in a locking system which is constituted by a housing, a slider provided in the housing and having a plurality of opened grooves into which magnetic lock pins are inserted, and a pair of plates provided in the housing so that a magnetic card key can be inserted between the plates, said system being further constituted by; a lock setting changing unit comprising: a disc capable of rotating to change magnetic lock setting, said disc being inserted into at least one circular recess portion of the slider; and engagement means provided in the disc so as to prevent a setting tool from being relieved from the disc in the middle of changing the magnetic lock setting; wherein the setting tool is inserted into a center hole of the disc, the disc is rotated by the setting tool so that the magnetic lock setting is changed into a new magnetic lock setting position, and the setting tool is allowed to be relieved from the disc after the magnetic lock setting is changed.

This lock setting changing unit in the locking system has a feature that a sliding ember is provided in a closed-end hole crossing a middle of the rotatable disc while being urged outward by a spring; and a cut-off shoulder is formed in the sliding member on one side thereof which is perpendicular to a direction along which a groove is opened in the sliding member, wherein a setting tool is inserted into a center hole of the disc so that an engagement groove of the setting tool is engaged with the groove of the sliding member, the disc is rotated by the setting tool so that magnetic lock setting can be changed into a new magnetic lock setting position, and then a top end head portion of the sliding member is urged by a spring so as to be inserted into one of corresponding engagement grooves in a circuit recess portion, so that the setting tool is allowed to be relieved from the groove of the sliding member.

This lock setting changing unit in the locking system has a feature that the top end head portion of a sliding member comes into contact with a circumference of the circular recess portion when the disc is rotated by the setting tool, and an upper side of an axial groove of a spindle shaft of the setting tool engages with a cut-off shoulder formed in the sliding member on one side thereof perpendicular to a direction along which a groove is opened in the sliding member, so that the setting tool cannot be relieved from the disc; and when the disc is rotated to a new magnetic lock setting position by the setting tool, the sliding member is pressed out to one of corresponding engagement grooves in the circular recess portion of the slider by spring force, so that the upper side of the axial groove of the spindle shaft of the setting tool is released from engagement with the cut-off shoulder of the groove of the sliding member, and the setting tool can be then relieved from the disc.

The lock setting changing unit in the locking system has a feature that the magnetic lock pins are inserted into a plurality of grooves opened outward in the slider, and an axial groove opened outward is provided also in the disc, so that a magnet inserted into the groove changes its position relative to the slider in accordance with the rotation of the disc.

The lock setting changing unit in the locking system has a feature that the setting tool is constituted by a spindle shaft and a grip which are circular in cross section, and a top end of the spindle shaft is formed with a curvature. The spindle shaft has a semicircularly cut-off portion which is semicirclularly cut off from the top end by about one third of the length of the spindle shaft. The semicircular cut-off portion of the spindle shaft forms a long groove in the axial direction of the spindle shaft, and the axial groove of the spindle shaft of the setting tool is engaged with the groove of the sliding member, so that the setting tool cannot be relieved from the groove of the sliding member until the disc is rotated to a new magnetic lock setting position.

The lock setting changing unit according to the present invention has a simple structure, can perform an accurate operation and can give a high sense of safety and a high sense of reliability to a user.

DETAILED DESCRIPTION OF THE PREFERRED EMBODIMENTS

An embodiment of the Present invention will be described with reference to the accompanying drawings. A locking system having a lock setting changing unit according to the present invention is attached to a door of a guest room of a hotel. A housing 2 forms the right half of a knob 1, and the knob 1 is attached to a spindle 4. Well-known parts in the configuration of the knob 1 will not be described in detail. If the knob 1 is rotated at an unlocking position of the locking system, a tail stock piece 6 rotates to bring an action to a latch of a door (not shown) and the door can be opened.

Figure 1:
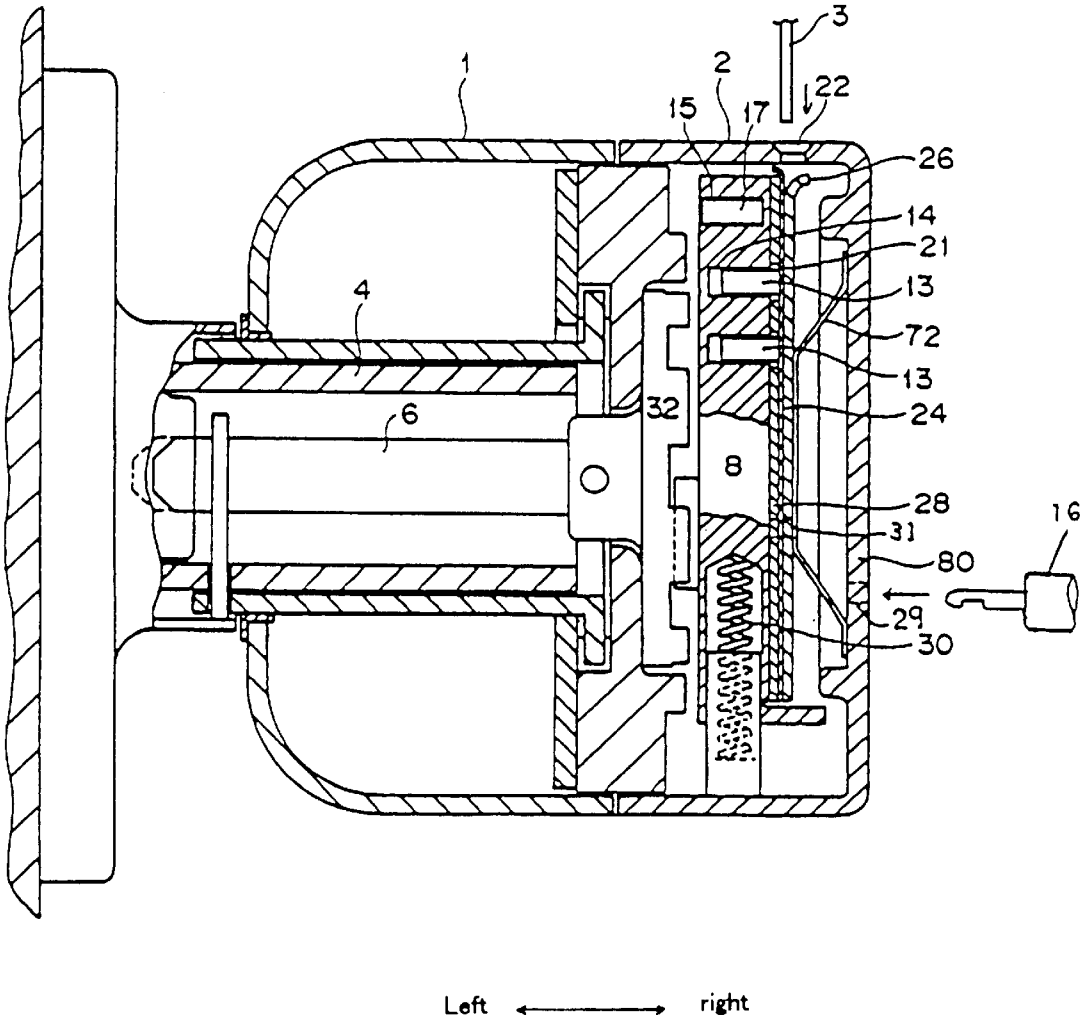
FIG. 1 is a sectional side view of a locking system having a lock setting changing unit according to the present invention.

When a magnetic card key 3 is inserted into a slot 22 of the housing 2 and pressed down, a slider 8 moves downward from a locking position shown in FIG. 1. When the slider 8 reaches the unlocking position, a rectangular projection of the slider 8 engages the teeth of a gear wheel plate 32. Then, the gear wheel plate 32 and the tail stock piece 6 are rotated together with the rotation of the knob 1. The card key 3 is inserted between a non-magnetic cover plate 24 and a magnetic shield plate 26. The shield plate 26 is pressed so as to contact to the cover plate 24 by a plate spring 72. In the locking position, a plurality of magnetic lock pins 13 project partially from holes 14 of the slider 8, and are received in corresponding holes 21 of a lock plate 28.

When the magnetic lock pins 13 are retreated to the inside of the slider 8 due to the insertion of the card key 3, the slider 8 is allowed by the card key 3 to move downward against a spring 30. By providing a magnet on the plane of the card key 3 correspondingly to the arrangement and polarity of the lock pins 13, all the lock pins 13 are retreated so that the slider 8 is moved from the locking position to the unlocking position.

The tail stock piece 6 can move from the solid line position to the dotted line position shown in FIG. 1. An extension pin is provided integrally with an inner end portion of the tail stock piece 6. The extension pin penetrates a groove hole 56 of the slider 8 and a hole of the lock plate 28 in the axial direction and extends to a hole of the cover plate 24.

Figure 2:
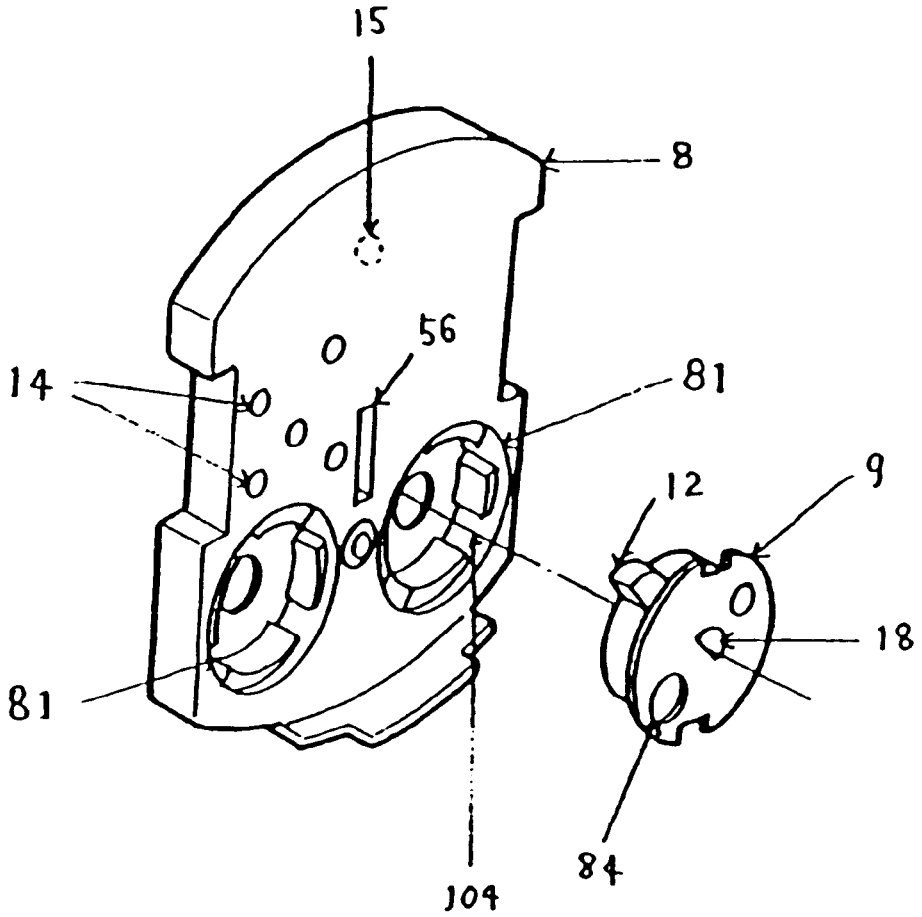
FIG. 2 is a perspective view of a slider provided in the lock setting changing unit according to the present invention.

As shown in FIG. 2, two circular recess portions 81 recessed in the axial direction (the left-right direction of FIG. 1) of the circle are provided in the slider 8. A disc 9 of a non-magnetic material is rotatably received in each of the recess portions 81. In order to define the rotation position of the disc 9, there are provided engagement grooves 104 formed in the circumference of the recess portion 81, a closed-end hole 88 crossing the middle of the disc 9 (see FIG. 4), and a sliding member 12 received in the closed-end hole 88 while being urged outward by a spring 10.

An axial groove 84 which is opened outward is provided in the disc 9. A magnetic lock pin 86 is received in the axial groove 84 movably in the axial direction. The magnetic lock pin 86 enters the corresponding hole of the lock plate 28 in the same manner as the plurality of magnetic lock pins 13 received correspondingly in the axial holes 14 of the slider 8. Thus, the magnetic lock pin 86 is retreated from the lock plate 28 by the insertion of the card key 3 in the locking position in the same manner as the magnetic lock pins 13.

In order to rotate the disc 9, a setting tool 16 having a complementary non-circular engagement portion 16*d* is inserted into a flange-side non-circular center hole 18 of the disc 9 through an opening 29 of a wall 80 of the housing 2. In order to allow the insertion of the setting tool 16, openings 31 are provided in the lock plate 28, the cover plate 24 and the shield plate 26, respectively.

The disc 9 forms a lock pin support, and the lock pin 86 forms a code changing lock pin.

In a regular locking position, the center hole 18 of the disc 9 is located in an intermediate position of the corresponding hole of the lock plate 28. To insert the setting tool 16, it is necessary to press down the slider 8 by the card key 3. When the slider 8 is pressed down by the regular-use card key 3, the disc 9 may be rotated mischievously. In order to prevent such mischief, a lock pin 17 is provided in the lock plate 28 so as to be inserted into an axial groove 15 on the back side of the slider 8. In order to change the code, it is necessary to release the movement distance limitation of the slider 8 set by the lock pin 17.

Figure 3A:
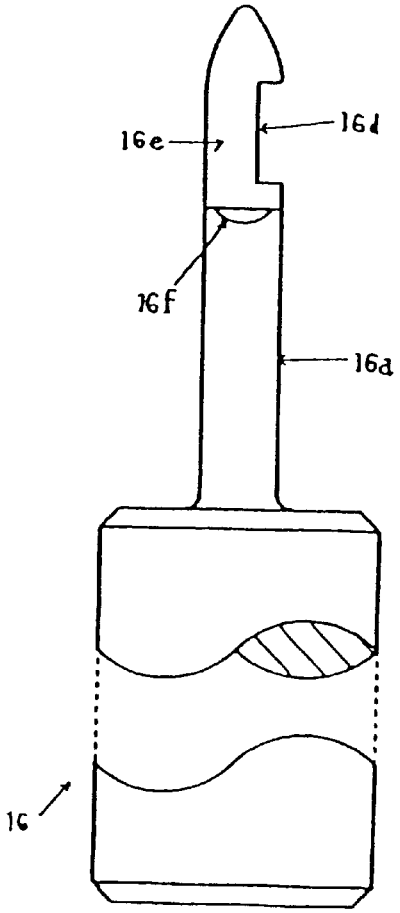
FIGS. 3A to 3C are side views of setting tools according to the present invention.
Figure 3B:
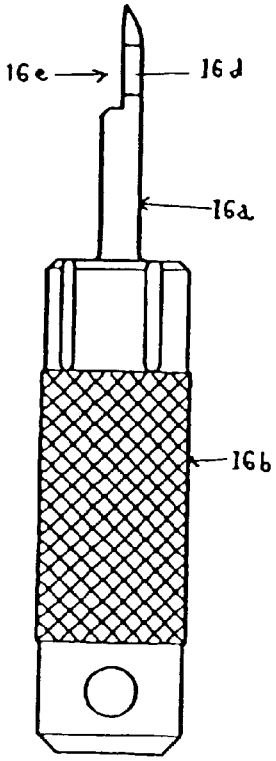
Figure 3C:
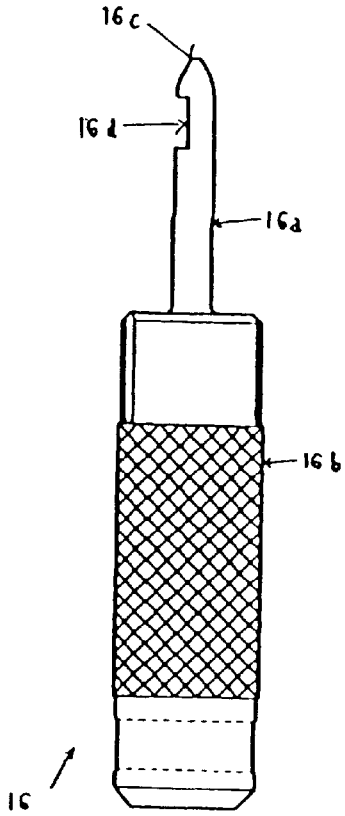

As shown in each of FIGS. 3A to 3C, the setting tool 16 is constituted by a spindle shaft 16*a* and a grip 16*b* which are circular in cross section. A top end 16*c* of the spindle shaft 16*a* is formed with a curvature. The spindle shaft 16*a* has a semicircular cut-off portion 16*e* which is semicirclularly cut off from the top end 16*c* by about one third of the length of the spindle shaft 16*a*. A long groove 16*d* in the axial direction of the spindle shaft 16*a* is formed by removing the semicircular cut off portion 16*e*. In addition, a shaft edge cut-off 16*f* is formed on a cut-off side rising from the semicircular cut-off portion 16*e*.

FIG. 3A shows a side view of a setting tool 16 in which a long groove 16*d* in the axial direction of the spindle shaft 16*a* is formed. FIG. 3B shows a side view of another setting tool 16 in which the semicircular cut-off portion 16*e* is viewed from its side. FIG. 3C shows a side view of a further setting tool 16 in which the semicircular cut-off portion 16*e* is viewed from a top in plan view.

In order to change the code, the code changing card key 3 is inserted into the slot 22 of the housing 2 shown in FIG. 1. When the code changing card key 3 is pressed down, the slider 8 moves downward from the locking position in FIG. 1. If the slider 8 reaches the unlocking position, the rectangular projection of the slider 8 engages the teeth of the gear wheel plate 32. Thus, the gear wheel plate 32 and the tail stock plate 6 are rotated together with the rotation of the knob 1. The code changing card key 3 is inserted between the non-magnetic cover plate 24 and the magnetic shield plate 26 so as to release the movement distance limitation of the slider 8 set by the lock pin 17. Thus, the openings 31 provided in the lock plate 28, the cover plate 24 and the shield plate 26 respectively are adjusted to the opening 29 of the wall 80 of the housing 2 so as to allow the setting tool 16 to be inserted to the opening 29. The setting tool 16 engages with the disc 9 provided on the slider 8 so as to rotate the disc 9. Thus, the lock setting position can be changed.

Figure 4:
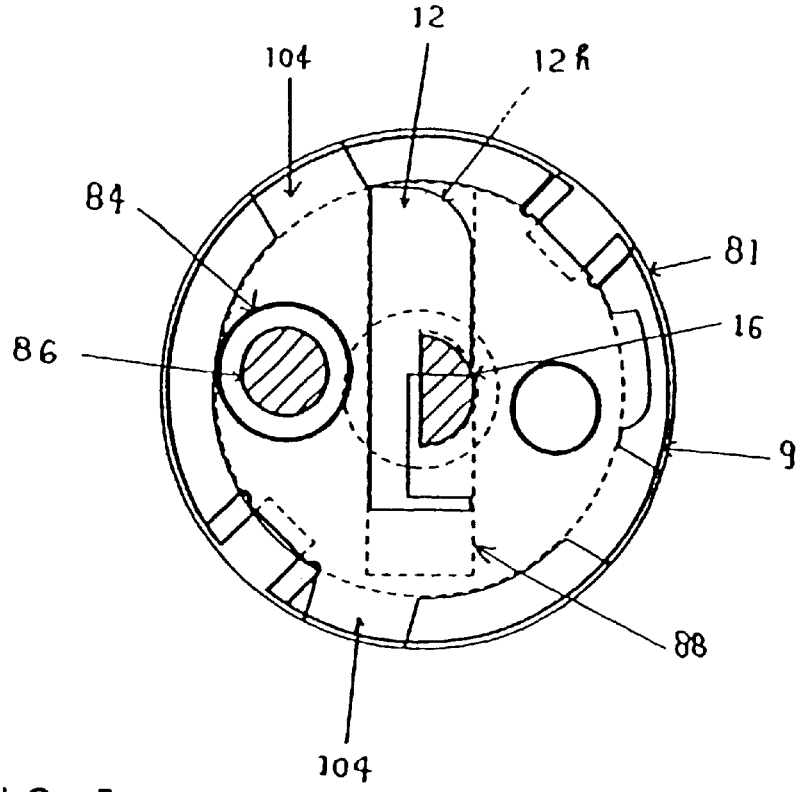
FIG. 4 is a plan view showing the state where the setting tool is brought into action upon a disc received in a circular recess portion of the slider of the lock setting changing unit according to the present invention.
Figure 5:
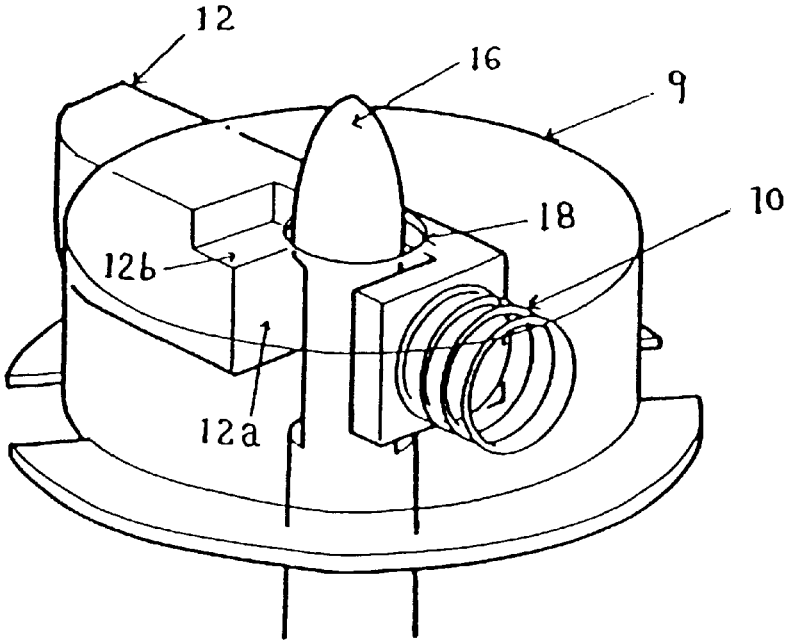
FIG. 5 is a perspective view showing the state where the setting tool is brought into action upon the disc of the lock setting changing unit according to the present invention.

FIGS. 4 and 5, show the disc 9 constituting the lock setting changing unit according to the present invention. The sliding member 12 is received in a closed-end hole 88 crossing the middle of the disc 9 while being urged outward by a spring 10. When the disc 9 rotated by the setting tool 16 comes into a new magnetic lock setting position, the sliding member 12 is pressed out to one of engagement grooves 104 in the circular recess portion 81 of the slider 8 by the spring force. Thus, a top end head portion 12*h* of the sliding member 12 is inserted into the engagement groove 104 in the circular recess portion 81 and when lock setting can be changed to the new magnetic lock setting position, the axial groove 16*d* of the setting tool 16 is released from the engagement with the sliding member groove 12*a*. Thus, the setting tool 16 can be relieved from the disc 9.

The sliding member 12 has a groove 12*a* correspondingly engaging with the non-circular engagement portion 16*d* of the setting tool 16, that is, the axial groove 16*d* which is opened upward. A cut-off shoulder 12*b* is formed in the sliding member 12 on one side thereof which is perpendicular to the direction along which the groove 12*a* is opened. When the disc 9 is rotated by the setting tool 16, the top end head portion 12*h* of the sliding member 12 is brought into contact with the circumference of the circular recess portion 81 while the upper side of the axial groove 16*d* of the spindle shaft 16*a* is brought into engagement with the cut-off shoulder 12*b*.

Magnetic lock pins 13 are inserted into a plurality of grooves 14 which are opened outward in the slider 8. In addition, an axial groove 84 which is opened outward is provided also in the disc 9. A magnetic lock pin 86 inserted into the axial groove 84 changes its position relative to the slider 8 in accordance with the rotation of the disc 9.

Figure 6:
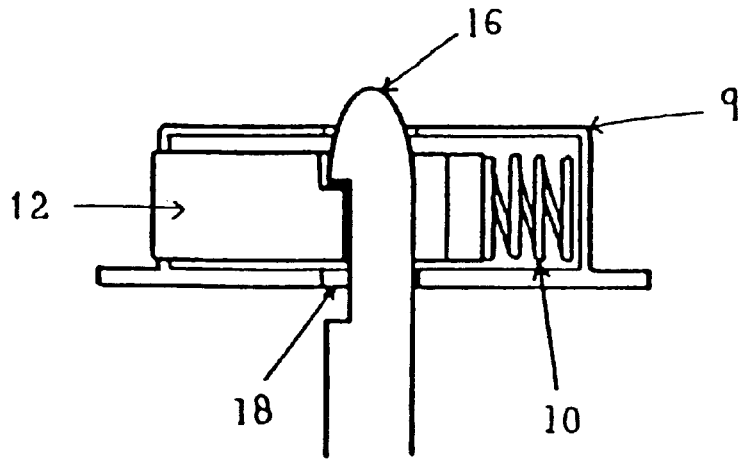
FIGS. 6(*a*) to 6(*c*) are side views respectively showing the state of engagement between the lock-position-changing disc and the setting tool in the lock setting changing unit according to the present invention.
Figure 6:
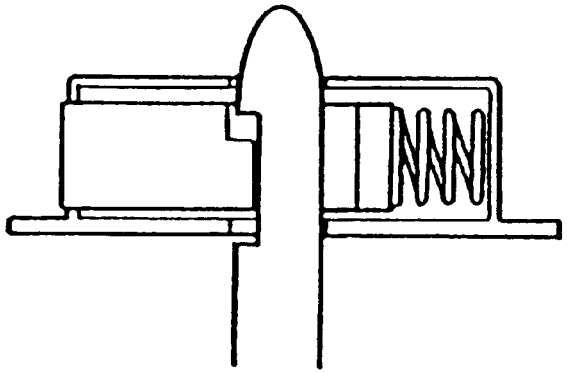
Figure 6:
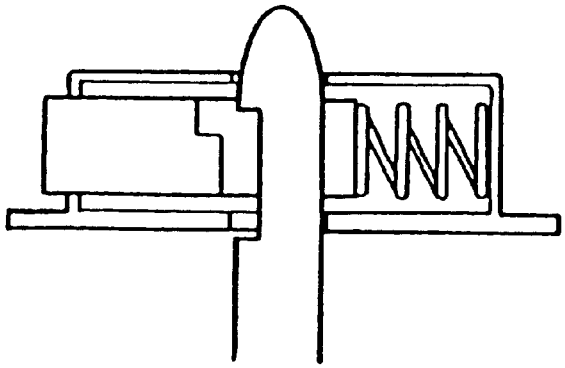
Figure 6:
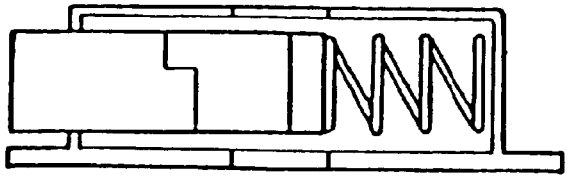

FIGS. 6(*a*) to 6(*d*) show the relationship of engagement between the lock-position-changing disc 9 of the lock setting changing unit and the setting tool 16 shown in FIGS. 3A–3C. FIG. 6(*a*) shows the state where the sliding member 12 of the disc 9 engages with the setting tool 16 so that the setting tool 16 cannot be relieved from the lock setting changing unit even if the setting tool 16 is tried to be relieved. FIG. 6(*b*) shows the state where the sliding member 12 of the disc 9 rotated for changing the lock setting by the setting tool 16 engages with the setting tool 16. FIG. 6(*c*) shows the state where the setting tool 16 has been inserted into the lock-position-changing disc 9 of the lock setting changing unit, or the state where the setting tool 16 has come to a new magnetic lock setting position so that the axial groove 16*d* of the setting tool 16 and the sliding member groove 12*a* have been released from engagement. FIG. 6(*d*) shows the state where the setting tool 16 has been removed from the locking system.

According to the lock setting changing unit according to the present invention, the setting tool is brought into engagement with the sliding member groove while the disc is rotated. Accordingly, the setting tool cannot be relieved from the disc until the lock setting of the disc can be changed to a new magnetic lock setting position. After the lock setting is changed, the setting tool can be relieved from the sliding member groove. Thus, the setting tool is not at all relieved in the middle of changing the lock setting. So long as the setting tool is not in a correct lock setting position, the setting tool is not at all relieved. Thus, a correct change can be achieved.

The lock setting changing unit according to the present invention has a simple structure, can perform an accurate changing operation and can give a high sense of security and a high sense of reliability on the locking system to a user.

What is claimed is:

1. In a locking system constituted by a housing, a slider provided in said housing and having a plurality of opened grooves into which magnetic lock pins are inserted, and a pair of plates provided in said housing so that a magnetic card key can be inserted between said plates, said system being further constituted by;

a lock setting changing unit for changing lock setting of said locking system comprising:

a disc capable of rotating to change magnetic lock setting, said disc being inserted into at least one circular recess portion of said slider; and engagement means provided in said disc so as to prevent a setting tool from being relieved from said disc in the middle of changing said magnetic lock setting;

wherein said setting tool is inserted into a center hole of said disc, said disc is rotated by said setting tool so that said magnetic lock setting is changed into a new magnetic lock setting position, and said setting tool is allowed to be relieved from the disc after said magnetic lock setting is changed.

2. In a locking system constituted by a housing, a slider provided in said housing and having a plurality of opened grooves into which magnetic lock pins are inserted, and a pair of plates provided in said housing so that a magnetic card key can be inserted between said plates, said system being further constituted by;

a lock setting changing unit for changing lock setting of said locking system comprising:

a rotatable disc;

a sliding member provided in a closed-end hole crossing a middle of said rotatable disc while being urged outward by a spring; and a cut-off shoulder formed in said sliding member on one side thereof which is perpendicular to a direction along which a groove is opened in said sliding member, wherein a setting tool is inserted into a center hole of said disc so that an engagement groove of said setting tool is engaged with said groove of said sliding member, said disc is rotated by said setting tool so that magnetic lock setting can be changed into a new magnetic lock setting position, and then a top end head portion of said sliding member is urged by a spring so as to be inserted into one of corresponding engagement grooves in a circuit recess portion, so that said setting tool is allowed to be relieved from said groove of said sliding member.

3. A lock setting changing unit in a locking system according to claim 1;

wherein a top end head portion of a sliding member comes into contact with a circumference of said circular recess portion when said disc is rotated by said setting tool, and an upper side of an axial groove of a spindle shaft of said setting tool engages with a cut-off shoulder formed in said sliding member on one side thereof perpendicular to a direction along which a groove is opened in said sliding member, so that said setting tool cannot be relieved from said disc; and wherein when said disc is rotated to a new magnetic lock setting position by said setting tool, said sliding member is pressed out to one of corresponding engagement grooves in said circular recess portion of said slider by spring force, so that said upper side of said axial groove of said spindle shaft of said setting tool is released from engagement with said cut-off shoulder of said groove of said sliding member, and said setting tool can be then relieved from said disc.

* * * * *